US008517796B2

(12) United States Patent
Shinozaki

(10) Patent No.: US 8,517,796 B2
(45) Date of Patent: Aug. 27, 2013

(54) DRESSING APPARATUS, DRESSING METHOD, AND POLISHING APPARATUS

(75) Inventor: Hiroyuki Shinozaki, Tokyo (JP)

(73) Assignee: Ebara Corporation, Tokyo (JP)

( * ) Notice: Subject to any disclaimer, the term of this patent is extended or adjusted under 35 U.S.C. 154(b) by 277 days.

(21) Appl. No.: 12/791,979

(22) Filed: Jun. 2, 2010

(65) Prior Publication Data

US 2010/0311309 A1 Dec. 9, 2010

(30) Foreign Application Priority Data

Jun. 4, 2009 (JP) ..... 2009-134914

(51) Int. Cl.

| | |
|---|---|
| ***B24B 49/00*** | (2012.01) |
| ***B24B 55/00*** | (2006.01) |
| ***B24B 5/00*** | (2006.01) |
| ***B24B 1/00*** | (2006.01) |

(52) U.S. Cl.
USPC ..... 451/5; 451/56; 451/443

(58) Field of Classification Search
USPC ..... 451/5, 285, 24, 41, 56, 443
See application file for complete search history.

(56) References Cited

U.S. PATENT DOCUMENTS

| | | | | |
|---|---|---|---|---|
| 5,325,636 | A * | 7/1994 | Attanasio et al. | 451/24 |
| 5,658,183 | A * | 8/1997 | Sandhu et al. | 451/5 |
| 6,083,082 | A * | 7/2000 | Saldana | 451/5 |
| 6,123,607 | A * | 9/2000 | Ravkin et al. | 451/56 |
| 6,241,578 | B1 * | 6/2001 | Togawa et al. | 451/5 |
| 6,783,440 | B2 * | 8/2004 | Togawa et al. | 451/56 |
| 6,824,454 | B2 * | 11/2004 | Kimura et al. | 451/285 |
| 7,115,026 | B2 * | 10/2006 | Nakajima et al. | 451/291 |
| 7,840,305 | B2 * | 11/2010 | Behr et al. | 700/174 |
| 8,152,594 | B2 * | 4/2012 | Saito et al. | 451/5 |
| 2002/0055325 | A1 * | 5/2002 | Suzuki | 451/285 |
| 2004/0180610 | A1 * | 9/2004 | Togawa | 451/41 |
| 2008/0287043 | A1 * | 11/2008 | Saito et al. | 451/285 |

FOREIGN PATENT DOCUMENTS

| | | |
|---|---|---|
| JP | 58-178533 | 10/1983 |
| JP | 10-071560 | 3/1998 |
| JP | 10-217102 | 8/1998 |
| JP | 2001-079752 | 3/2001 |
| JP | 2001-510737 | 8/2001 |
| JP | 2001-334461 | 12/2001 |
| JP | 2002-525885 | 8/2002 |
| JP | 2003-039314 | 2/2003 |
| JP | 2004-319730 | 11/2004 |
| WO | 99/02305 | 1/1999 |
| WO | 00/18542 | 4/2000 |

* cited by examiner

*Primary Examiner* — Lee D Wilson
*Assistant Examiner* — Tyrone V Hall, Jr.
(74) *Attorney, Agent, or Firm* — Wenderoth, Lind & Ponack, L.L.P.

(57) ABSTRACT

A dressing apparatus is used in a polishing apparatus for polishing a substrate to planarize a surface of the substrate. The dressing apparatus includes a dresser disk, a dresser drive shaft coupled to the dresser disk, a pneumatic cylinder configured to press the dresser disk against the polishing pad through the dresser drive shaft, a pressure-measuring device configured to measure pressure of the gas supplied to the pneumatic cylinder, a load-measuring device configured to measure a load acting on the dresser drive shaft, and a pressure controller configured to control the pressure of the gas supplied to the pneumatic cylinder. The pressure controller is configured to establish a relationship between the pressure of the gas and a pressing force of the dresser disk against the polishing pad, based on measurement values of the pressure-measuring device and the load-measuring device.

11 Claims, 14 Drawing Sheets

DRESSING APPARATUS, DRESSING METHOD, AND POLISHING APPARATUS

BACKGROUND OF THE INVENTION

1. Field of the Invention

The present invention relates to a dressing apparatus and a dressing method for dressing a polishing pad used in polishing of a substrate, such as a semiconductor wafer. More particularly, the present invention relates to a dressing apparatus and a dressing method used in a polishing apparatus for polishing the substrate to planarize a surface of the substrate. The present invention also relates to a polishing apparatus having such a dressing apparatus.

2. Description of the Related Art

Semiconductor devices become smaller and smaller in recent years, and device structures become more complicated. A surface planarization is an essential process in fabrication of the semiconductor devices. A typical technique used in the surface planarization is chemical mechanical polishing (CMP). In this chemical mechanical polishing, a substrate is brought into sliding contact with a polishing surface of a polishing pad, while a polishing liquid, containing abrasive particles such as silica ($SiO_2$), is supplied onto the polishing surface, whereby a surface of the substrate is polished.

The chemical mechanical polishing is performed using a CMP apparatus. The CMP apparatus includes a polishing table with a polishing pad attached to an upper surface thereof, and a top ring for holding a substrate, such as a semiconductor wafer, which is a workpiece to be polished. While the polishing table and the top ring are rotated about their own axes respectively, the top ring presses the substrate against a polishing surface (i.e., an upper surface) of the polishing pad at predetermined pressure to cause sliding contact between the substrate and the polishing pad. In this state, the polishing liquid is supplied onto the polishing surface of the polishing pad. The substrate is thus polished in the presence of the polishing liquid between the substrate and the polishing pad. The surface of the substrate is planarized by a combination of a chemical polishing action by alkali and a mechanical polishing action by abrasive particles.

When the substrate is polished, the abrasive particles and polishing debris adhere to the polishing surface (the upper surface) of the polishing pad. In addition, characteristics of the polishing pad are altered and its polishing performance is lowered. Consequently, as polishing of the substrate is repeated, a polishing speed (i.e., a removal rate) is lowered and uneven polishing occurs. Thus, in order to regenerate the deteriorated polishing surface of the polishing pad, a dressing apparatus is provided adjacent to the polishing table. This dressing apparatus regenerates the polishing surface of the polishing pad by slightly scraping off the polishing surface.

FIG. 1 is a schematic view showing a conventional dressing apparatus. As shown in FIG. 1, the dressing apparatus includes a dresser disk 131, an air cylinder 136 for pressing the dresser disk 131 against a polishing pad 10, and a dresser drive shaft 132 coupling the dresser disk 131 and the air cylinder 136 to each other. The dresser drive shaft 132 is divided into a rotating section coupled to the dresser disk 131 and a non-rotating section coupled to the air cylinder 136. The rotating section and the non-rotating section are coupled to each other via a coupling 137.

The rotating section of the dresser drive shaft 132 is supported by a ball spline 135. This ball spline 135 is a linear motion guide which transmits a torque to the dresser drive shaft 132, while allowing a straight line motion of the dresser drive shaft 132 in a longitudinal direction thereof. The ball spline 135 is coupled to a motor (not shown), so that the dresser disk 131 is rotated by the motor through the dresser drive shaft 132.

The air cylinder 136 is a double-acting air cylinder in which two pressure chambers are provided on both sides of a piston 136*a*. Air, with adjusted pressure, is injected into each pressures chamber. Specifically, compressed air to generate a load on the polishing pad 10 is introduced into the upper pressure chamber, and on the other hand compressed air to support a weight of a movable section, including the dresser disk 131 and the dresser drive shaft 132, is introduced into the lower pressure chamber. The pressure of the air supplied to the lower pressure chamber is kept constant. A pressing force of the dresser disk 131 against the polishing pad 10 is determined by differential pressure between the upper pressure chamber and the lower pressure chamber.

Hard abrasive particles, such as diamond particles, are fixed to a lower surface of the dresser disk 131. This lower surface of the dresser disk 131 constitutes a dressing surface for conditioning the polishing surface of the polishing pad 10. When dressing the polishing pad 10, the dresser disk 131 is pressed against the polishing pad 10, while a polishing table 11 and the dresser disk 131 are rotated and pure water is supplied onto the polishing surface of the polishing pad 10. The polishing surface of the polishing pad 10 is dressed (or conditioned) by sliding contact between the dressing surface of the dresser disk 131 and the polishing surface.

During dressing, the polishing surface of the polishing pad 10 is scraped by the dresser disk 131. The pressing force of the dresser disk 131 against the polishing pad 10 has a great influence on a life of the polishing pad 10. Therefore, it is necessary to accurately control the pressing force of the dresser disk 131. In the above-described structures, since the air having constant pressure is supplied into the lower pressure chamber of the air cylinder 136, the pressing force of the dresser disk 131 depends on the pressure of the air introduced into the upper pressure chamber. Thus, calibration is necessary in order to establish a relationship between the pressing force of the dresser disk 131 and the pressure of the air introduced into the upper pressure chamber of the air cylinder 136.

The calibration is performed by inserting a load-measuring device (e.g., a load cell) between the polishing pad 10 and the dresser disk 131 and associating measurement value (i.e., the pressing force), obtained from the load-measuring device, with the pressure of the air supplied to the air cylinder 136. However, in order to carry out the calibration, it is necessary to stop operations of the polishing apparatus. As a result an operation rate of the polishing apparatus is lowered.

In addition to the above-described problem, the dressing apparatus using the air cylinder entails the following drawback. As described above, the pressing force of the dresser disk 131 against the polishing pad 10 affects the lifetime of the polishing pad 10. Therefore, in order to extend the life of the polishing pad 10, it is necessary to decrease the pressing force of the dresser disk 131 to some extent. However, when the pressure of the air in the upper pressure chamber of the air cylinder 136 is lowered, the piston may not move in spite of the differential pressure between the upper pressure chamber and the lower pressure chamber. This is because, when the differential pressure between the upper pressure chamber and the lower pressure chamber is close to zero, frictional resistance between the piston and a cylinder and frictional resistance between the dresser drive shaft 132 and the air cylinder 136 become relatively high. In such a dead zone where the air cylinder 136 does not operate, good dressing of the polishing pad 10 is not performed and as a result, stable polishing performance of the polishing pad 10 cannot be achieved.

SUMMARY OF THE INVENTION

The present invention has been made in view of the above-described drawbacks. It is therefore a first object of the present invention to provide a dressing apparatus and a dressing method capable of establishing a relationship between pressing force of a dresser disk and pressure of a gas generating the corresponding pressing force, without stopping operations of a polishing apparatus.

It is a second object of the present invention to provide a dressing apparatus capable of stably producing a low pressing force of the dresser disk.

In order to achieve the above object, one aspect of the present invention provides a dressing apparatus for dressing a polishing pad. The apparatus includes: a dresser disk to be brought into sliding contact with the polishing pad; a vertically movable dresser drive shaft coupled to the dresser disk; a pressing mechanism configured to receive supply of a gas to press the dresser disk against the polishing pad through the dresser drive shaft; a pressure-measuring device configured to measure pressure of the gas supplied to the pressing mechanism; a load-measuring device configured to measure a load acting on the dresser drive shaft; and a pressure controller configured to control the pressure of the gas supplied to the pressing mechanism. The pressure controller is configured to establish a relationship between the pressure of the gas and a pressing force of the dresser disk against the polishing pad, based on measurement values of the pressure-measuring device and the load-measuring device.

Another aspect of the present invention is to provide a polishing apparatus for polishing a substrate. The apparatus includes: a rotatable polishing table for supporting a polishing pad; a top ring configured to press the substrate against the polishing pad; and the above-described dressing apparatus.

Still another aspect of the present invention is to provide a dressing apparatus for dressing a polishing pad. The apparatus includes: a dresser disk to be brought into sliding contact with the polishing pad; a vertically movable dresser drive shaft coupled to the dresser disk; a pneumatic cylinder configured to press the dresser disk against the polishing pad through the dresser drive shaft; a lifting mechanism configured to lift the dresser disk through the dresser drive shaft; and a pressure controller configured to control pressure of a gas supplied to the pneumatic cylinder.

In a preferred aspect of the present invention, the lifting mechanism comprises a spring.

In a preferred aspect of the present invention, the dressing apparatus further includes a position sensor configured to measure a position of the dresser disk in a vertical direction when the dresser disk is in contact with the polishing pad.

In a preferred aspect of the present invention, the pressure controller is configured to change the pressure of the gas supplied to the pneumatic cylinder based on a measurement value of the position sensor.

In a preferred aspect of the present invention, the dressing apparatus further includes: a load-measuring device configured to measure a load acting on the dresser drive shaft; and a pressure-measuring device configured to measure the pressure of the gas supplied to the pneumatic cylinder. The pressure controller is configured to determine an amount of wear of the polishing pad from a measurement value of the position sensor and establish a relationship between the pressure of the gas and a pressing force of the dresser disk against the polishing pad, based on measurement values of the pressure-measuring device and the load-measuring device, when the amount of wear of the polishing pad has reached a predetermined value.

In a preferred aspect of the present invention, the dressing apparatus further includes: a load-measuring device configured to measure a load acting on the dresser drive shaft; and a pressure-measuring device configured to measure the pressure of the gas supplied to the pneumatic cylinder. The pressure controller is configured to establish a relationship between the pressure of the gas and a pressing force of the dresser disk against the polishing pad, based on measurement values of the pressure-measuring device and the load-measuring device.

In a preferred aspect of the present invention, the dressing apparatus further includes a load-measuring device configured to measure a load acting on the dresser drive shaft. The pressure controller is configured to control the pressure of the gas based on a measurement value of the load-measuring device such that a pressing force of the dresser disk against the polishing pad is kept at a predetermined target value during dressing of the polishing pad.

Still another aspect of the present invention is to provide a polishing apparatus for polishing a substrate. The apparatus includes: a rotatable polishing table for supporting a polishing pad; a top ring configured to press the substrate against the polishing pad; and the above-described dressing apparatus.

Still another aspect of the present invention is to provide a method of dressing a polishing pad. The method includes: rotating a dresser disk and the polishing pad; pressing the dresser disk against the polishing pad through a dresser drive shaft by a pressing mechanism that is actuated by receiving supply of a gas; measuring pressure of the gas supplied to the pressing mechanism; measuring a load acting on the dresser drive shaft; and establishing a relationship between the pressure of the gas and a pressing force of the dresser disk against the polishing pad, based on measurement values of the pressure of the gas and measurement values of the load.

According to the present invention, the load-measuring device, incorporated in the dresser drive shaft, can establish the relationship between the pressing force and the pressure of the gas within a very short period of time before or after the dressing operation or during the dressing operation. Therefore, it is not necessary to stop the operations of the polishing apparatus and as a result the operation rate of the polishing apparatus can be improved.

Further, according to the present invention, providing of the lifting mechanism enables setting of a large gas-pressure difference between two pressure chambers in the air cylinder. Therefore, operating zone of the air cylinder lies out of the dead zone (which is a zone where the piston does not operate in spite of a change in the differential pressure). Hence, the air cylinder can generate low pressing forces stably.

DETAILED DESCRIPTION OF THE PREFERRED EMBODIMENTS

Figure 1:
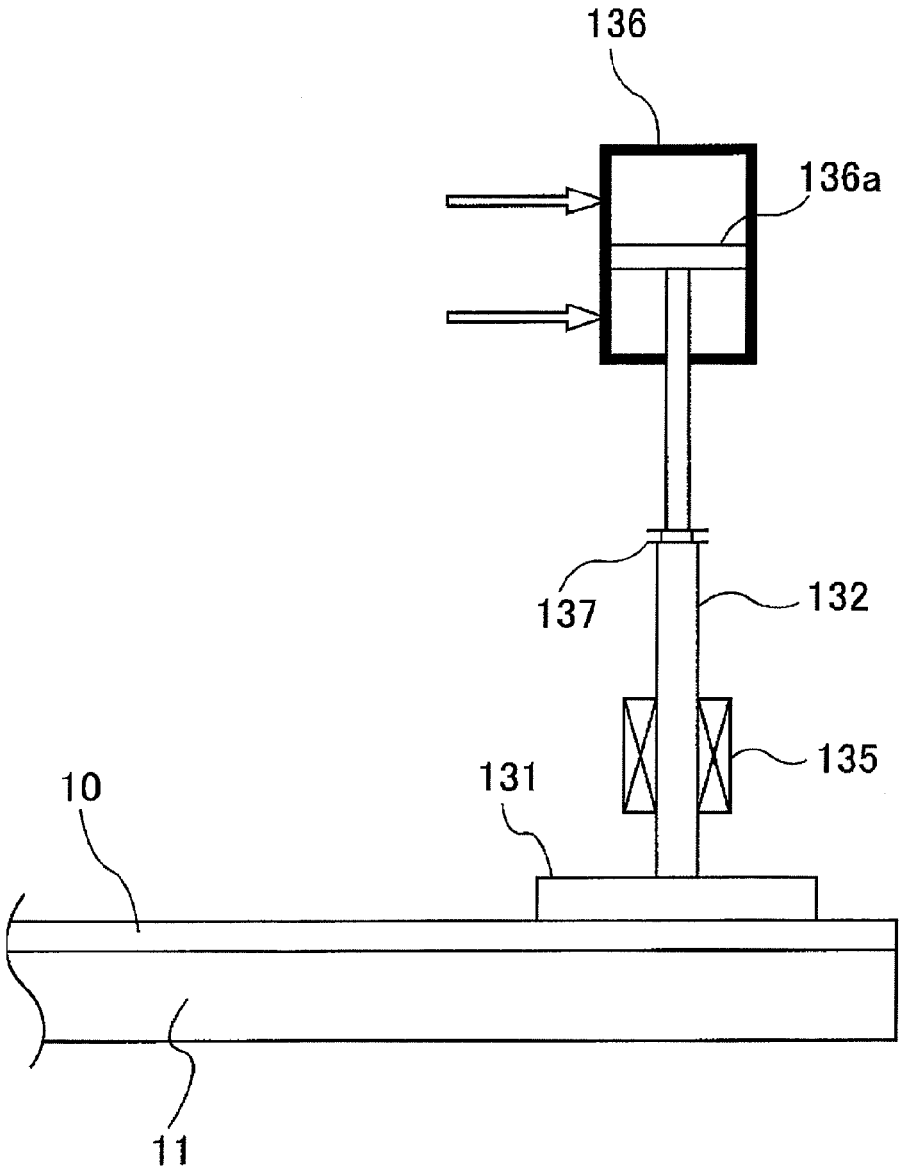
FIG. 1 is a schematic view showing a conventional dressing apparatus.

Embodiments of the present invention will be described below with reference to the drawings. Like or corresponding structural elements are denoted by the same reference numerals in the following description and repetitive descriptions thereof will be omitted.

Figure 2:
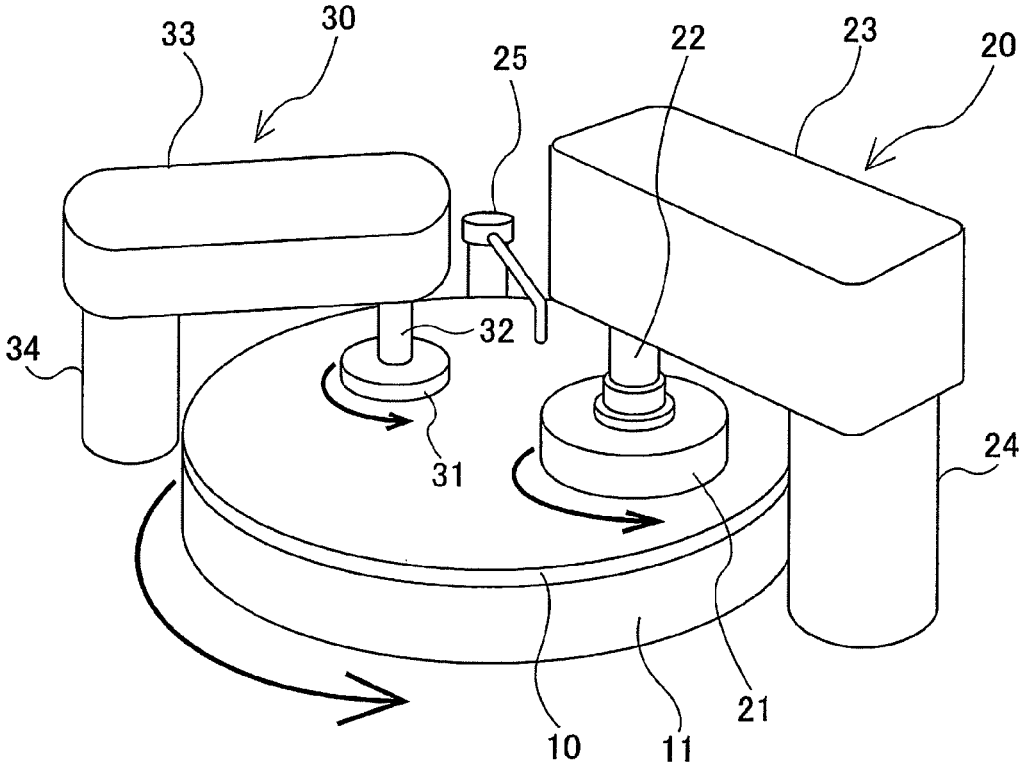
FIG. 2 is a perspective view of a polishing apparatus.

FIG. 2 is a perspective view showing a polishing apparatus. The polishing apparatus includes a polishing table 11 supporting a polishing pad 10, a top ring unit 20 for polishing a substrate (i.e., a workpiece to be polished), such as a wafer, by bringing it into sliding contact with the polishing pad 10, and a dressing unit (dressing apparatus) 30 configured to condition (i.e., dress) an upper surface of the polishing pad 10. The polishing pad 10 is attached to an upper surface of the polishing table 11, and an upper surface of the polishing pad 10 provides a polishing surface. The polishing table 11 is coupled to a motor (not shown), so that the polishing table 11 and the polishing pad 10 are rotated by the motor in a direction indicated by arrow.

The top ring unit 20 includes a top ring 21 configured to hold the substrate and press it against the upper surface of the polishing pad 10, a top ring drive shaft 22 coupled to the top ring 21, and a top ring swing arm 23 rotatably holding the top ring drive shaft 22. The top ring swing arm 23 is supported by a top ring swing shaft 24. A motor (not shown) is installed in the top ring swing arm 23 and this motor is coupled to the top ring drive shaft 22. Rotation of this motor is transmitted to the top ring 21 via the top ring drive shaft 22, whereby the top ring 21 is rotated about the top ring drive shaft 22 in a direction indicated by arrow.

A liquid supply mechanism 25 for supplying a polishing liquid and a dressing liquid onto the polishing surface of the polishing pad 10 is provided adjacent to the top ring unit 20. This liquid supply mechanism 25 has plural supply nozzles (not shown) from which the polishing liquid and the dressing liquid are supplied separately onto the polishing surface of the polishing pad 10. The liquid supply mechanism 25 serves as both a polishing-liquid supply mechanism for supplying the polishing liquid onto the polishing pad 10 and a dressing-liquid supply mechanism for supplying the dressing liquid (e.g., pure water) onto the polishing pad 10. The polishing-liquid supply mechanism and the dressing-liquid supply mechanism may be provided separately.

The top ring 21 has a lower surface that provides a substrate-holding surface for holding the substrate by a vacuum suction or the like. The top ring drive shaft 22 is coupled to a non-illustrated vertical-movement actuator (e.g., an air cylinder). With this configuration, the top ring 21 is elevated and lowered by the vertical-movement actuator through the top ring drive shaft 22. The top ring swing shaft 24 is located radially outwardly of the polishing table 11. This top ring swing shaft 24 is configured to rotate, so that the top ring 21 can move between a polishing position on the polishing pad 10 and a rest position outside the polishing pad 10.

Polishing of the substrate is performed as follows. The substrate is held on the lower surface of the top ring 21, and the top ring 21 and the polishing table 11 are rotated. In this state, the polishing liquid is supplied onto the polishing surface of the polishing pad 10, and then the top ring 21 presses the substrate against the polishing surface of the polishing pad 10. A surface (a lower surface) of the substrate is polished by the mechanical polishing action of abrasive particles contained in the polishing liquid and the chemical polishing action of the polishing liquid.

The dressing unit (dressing apparatus) 30 includes a dresser disk 31 to be brought into sliding contact with the polishing surface of the polishing pad 10, a dresser drive shaft 32 coupled to the dresser disk 31, and a dresser swing arm 33 rotatably holding the dresser drive shaft 32. A lower surface of the dresser disk 31 provides a dressing surface that is brought into sliding contact with the polishing surface of the polishing pad 10. Hard abrasive particles, such as diamond particles, are fixed to the dressing surface. The dresser swing arm 33 is supported by a dresser swing shaft 34. A motor (not shown) is installed in the dresser swing arm 33 and this motor is coupled to the dresser drive shaft 32. Rotation of this motor is transmitted to the dresser disk 31 via the dresser drive shaft 32, whereby the dresser disk 31 is rotated about the dresser drive shaft 32 in a direction indicated by arrow.

The dresser swing shaft 34 is coupled to a swing motor (not shown). When the swing motor is set in motion, the dresser disk 31 is moved on the polishing surface of the polishing pad 10 in substantially a radial direction of the polishing surface. When dressing the polishing pad 10, the dresser disk 31 is pressed against the polishing pad 10, while the polishing table 11 and the dresser disk 31 are rotated and the dressing liquid is supplied onto the polishing surface of the polishing pad 10. The polishing surface of the polishing pad 10 is conditioned by sliding contact between the dressing surface of the dresser disk 31 and the polishing surface. During dressing, the dresser disk 31 is oscillated in the radial direction of the polishing pad.

Figure 3:
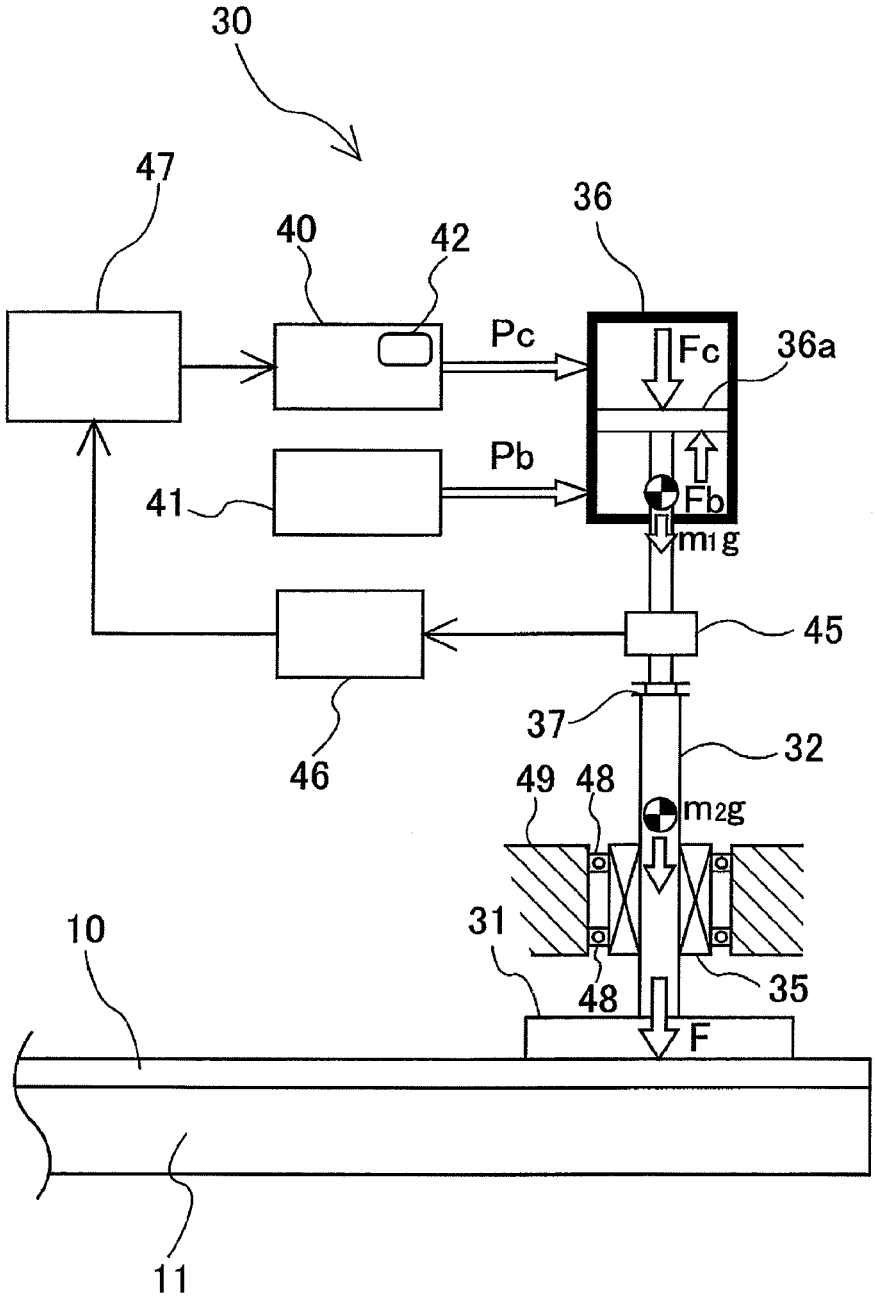
FIG. 3 is a schematic view showing a dressing apparatus according to a first embodiment of the present invention.

FIG. 3 is a schematic view showing the dressing unit 30 according to a first embodiment of the present invention. As shown in FIG. 3, the dressing unit 30 includes an air cylinder (a pneumatic cylinder) 36 as a pressing mechanism for pressing the dresser disk 31 against the polishing pad 10 through the dresser drive shaft 32. The dresser drive shaft 32 is supported by a ball spline 35. This ball spline 35 is a linear motion guide which transmits a torque to the dresser drive shaft 32, while allowing a straight line motion of the dresser drive shaft 32 in a longitudinal direction thereof. The ball spline 35 is rotatably supported by bearings 48, which are fixedly mounted on a support base 49 secured to the dresser swing arm 33. Relative positions of the support base 49 and the ball spline 35 in a vertical direction with respect to the dresser swing arm 33 are fixed.

A motor (not shown) is coupled to the ball spline 35 and this motor causes the dresser disk 31 to rotate through the dresser drive shaft 32. The dresser drive shaft 32 is divided into a rotating section coupled to the dresser disk 31 and a non-rotating section coupled to the air cylinder 36. The rotating section and the non-rotating section are coupled to each other by a coupling 37. The rotating section of the dresser drive shaft 32 has a shape of spline shaft and is supported by the ball spline 35 that allows the dresser drive shaft 32 to move vertically.

An upper end of the dresser drive shaft 32 is coupled to the air cylinder (pressing mechanism) 36, which is configured to press the dresser disk 31 against the polishing pad 10 through the dresser drive shaft 32. The air cylinder 36 is a double-acting air cylinder in which two pressure chambers are disposed on both sides of a piston 36*a*. This air cylinder 36 is a type of pneumatic actuator. An electropneumatic regulator 40, serving as a pressure-adjusting device, is coupled to an upper pressure chamber of the air cylinder 36. This electropneumatic regulator 40 is configured to adjust pressure of compressed air supplied from an air source (not shown) and deliver the air of adjusted pressure Pc to the upper pressure chamber of the air cylinder 36. Similarly, an electropneumatic regulator 41, serving as a pressure-adjusting device, is coupled to a lower pressure chamber of the air cylinder 36. The electropneumatic regulator 41 is configured to adjust pressure of the compressed air supplied from the above-mentioned air source and supply the air of adjusted pressure Pb to the lower pressure chamber of the air cylinder 36. Instead of the air, other type of gas may be used.

The air supplied to the upper pressure chamber generates a load on the polishing pad 10, and on the other hand the air supplied to the lower pressure chamber is counter air (or balance air) for supporting a weight of vertically movable components (which will be hereinafter referred to as "a dresser assembly") which include the dresser disk 31 and the dresser drive shaft 32. Pressure of the counter air is set to be large enough to support the weight of the dresser assembly and is kept constant during dressing. A pressing force of the dresser disk 31 against the polishing pad 10 is determined by differential pressure between the upper pressure chamber and the lower pressure chamber.

A load cell 45, which is a load-measuring device for indirectly measuring the pressing force applied to the polishing pad from the dresser disk 31, is provided in the dresser drive shaft 32. The load cell 45 is coupled to a pressure controller 47 via an amplifier 46. Measurement values (output signals) of the load cell 45 are amplified by the amplifier 46, and the amplified measurement values are transmitted to the pressure controller 47.

The pressing force acting on the polishing pad 10 is a resultant force of a downward force generated by the air cylinder 36 and the weight of the dresser assembly. More technically, the pressing force acting on the polishing pad 10 is further affected by frictional resistance between the ball spline 35 and the dresser drive shaft 32 and frictional resistance in a sealing element of the air cylinder 36. However, these frictional resistances are relatively minute compared to the force generated by the air cylinder 36 and the weight of the dresser assembly. Therefore, these frictional resistances will be omitted in below-described explanations.

The load cell 45 is incorporated in the dresser drive shaft 32 and measures a load acting on the dresser drive shaft 32. Therefore, there is a difference between the measurement value obtained by the load cell 45 and the actual pressing force. A pressing force F applied to the polishing pad 10 by the dresser disk 31, a measurement value F' of the load cell 45, and a difference between the pressing force F and the measurement value F' will be described with reference to FIG. 3. In a structure shown in FIG. 3, the pressing force F when the dresser disk 31 is in contact with the polishing pad 10 is expressed as $$F=Fc-Fb+m_1g+m_2g \tag{1}$$

where Fc represents a downward force generated by the air of pressure Pc introduced in the upper pressure chamber of the air cylinder 36, Fb represents an upward force generated by the air of pressure Pb introduced in the lower pressure chamber of the air cylinder 36, $m_1g$ represents a weight of an upper part of the dresser assembly with respect to the load cell 45 as the center of the dresser assembly, and $m_2g$ represents a weight of a lower part of the dresser assembly with respect to the load cell 45 as the center of the dresser assembly.

The load cell 45 is configured to measure not only a compressive force acting on the dresser drive shaft 32, but also a tensile force. When the dresser disk 31 is out of contact with the polishing pad 10, only the weight $m_2g$ of the lower part of the dresser assembly acts as a tensile force on the load cell 45. Therefore, the measurement value outputted from the load cell 45 in this state is—$m_2g$. On the other hand, when the dresser disk 31 is in contact with the polishing pad 10, the weight $m_2g$ of the lower part of the dresser assembly is not exerted on the load cell 45. The measurement value F' outputted from the load cell 45 when the dresser disk 31 is in contact with the polishing pad 10 is expressed as $$F'=Fc-Fb+m_1g \tag{2}$$

From the above equation (1) and the equation (2), the difference ΔS between the pressing force F and the measurement value F' is given by $$\Delta S=F-F'=m_2g \tag{3}$$

Therefore, the actual pressing force F can be determined by adding the difference ΔS (=$m_2g$), as an amount of correction, to the measurement value F' obtained from the load cell 45. This amount of correction ΔS can be given by a measurement value outputted from the load cell 45 when the dresser disk 31 is out of contact with the polishing pad 10. Alternatively, the amount of correction ΔS may be determined by placing a calibration load cell between the dresser disk 31 and the polishing pad 10 and subtracting the measurement value F' of the load cell 45 from the actual pressing force of the dresser disk 31 applied to the polishing pad 10 (i.e., the measurement value of the calibration load cell). This amount of correction ΔS (=$m_2g$) depends only on the weight of the lower part of the dresser assembly and the value of ΔS is substantially constant. Therefore, once the amount of correction ΔS is obtained, the value thereof can be used as it is repetitively.

The operation of obtaining the amount of correction is performed prior to processing of a substrate, and the amount of correction obtained is stored in the pressure controller 47. This pressure controller 47 adds the amount of correction $m_2g$ to the measurement value F', transmitted from the load cell 45, to thereby determine the pressing force F of the dresser disk 31 against the polishing pad 10.

The pressure controller 47 is configured to perform calibration for establishing a relationship between the pressing force F obtained from the measurement value F' of the load cell 45 and the pressure Pc of the air in the upper pressure chamber of the air cylinder 36. A pressure sensor (pressure-measuring device) 42 for measuring the pressure Pc of the air supplied into the upper pressure chamber of the air cylinder 36 is provided in the electropneumatic regulator 40. A measurement value of the pressure sensor 42 is transmitted to the pressure controller 47. The pressure controller 47 associates the pressing force F with the measurement value obtained at the same point of time by the pressure sensor 42 to thereby establish the relationship between the pressing force F of the dresser disk 31 and the air pressure Pc in the upper pressure chamber.

According to the present embodiment, unlike a conventional calibration, it is not necessary to stop the operations of the polishing apparatus for the calibration. Further, it is not necessary to sandwich a load-measuring device for calibration between the dresser disk 31 and the polishing pad 10. Therefore, calibration can be performed within a very short time and operation rate of the polishing apparatus can be improved.

Figure 4:
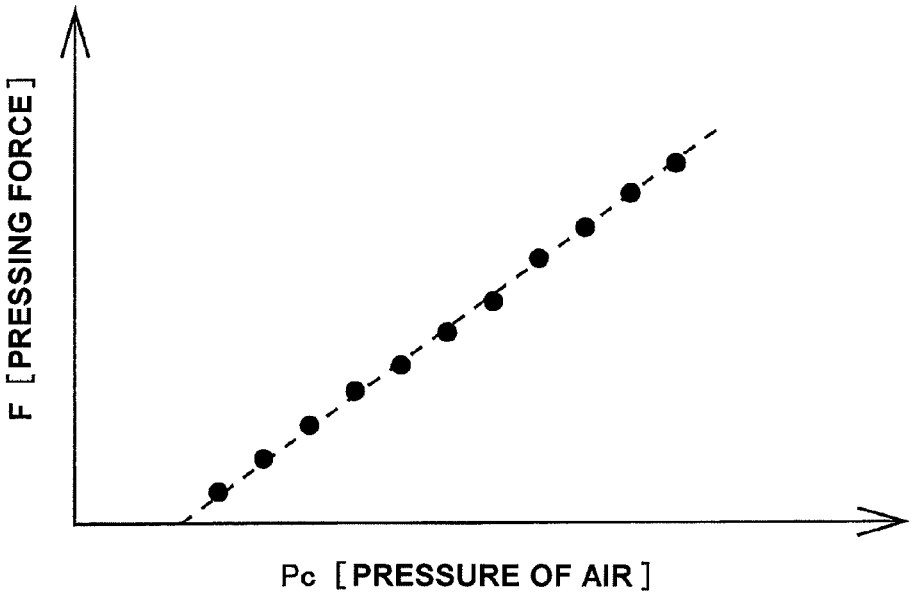
FIG. 4 is a graph showing a relationship, obtained by calibration, between pressing force of a dresser disk and pressure of air in an upper pressure chamber.

FIG. 4 is a graph showing the relationship, obtained by the calibration, between the pressing force of the dresser disk 31 and the pressure of the air in the upper pressure chamber. In FIG. 4, a vertical axis indicates the pressing force F of the dresser disk 31 and a horizontal axis indicates the pressure Pc of the air in the upper pressure chamber. As can be seen from the graph in FIG. 4, the pressing force of the dresser disk 31 is approximately in proportion to the pressure of the air in the upper pressure chamber. Therefore, the air pressure for generating a desired pressing force can be determined from the graph shown in FIG. 4.

The pressure controller 47 determines the air pressure corresponding to a desired pressing force that is inputted through an input device (now shown), based on the relationship, obtained by the calibration, between the pressing force and the air pressure, and commands the electropneumatic regulator 40 to supply the air having the determined pressure to the upper pressure chamber of the air cylinder 36. The air cylinder 36 imparts the pressing force to the dresser disk 31, and the dresser disk 31 presses the polishing pad 10 at the desired pressing force.

Figure 5:
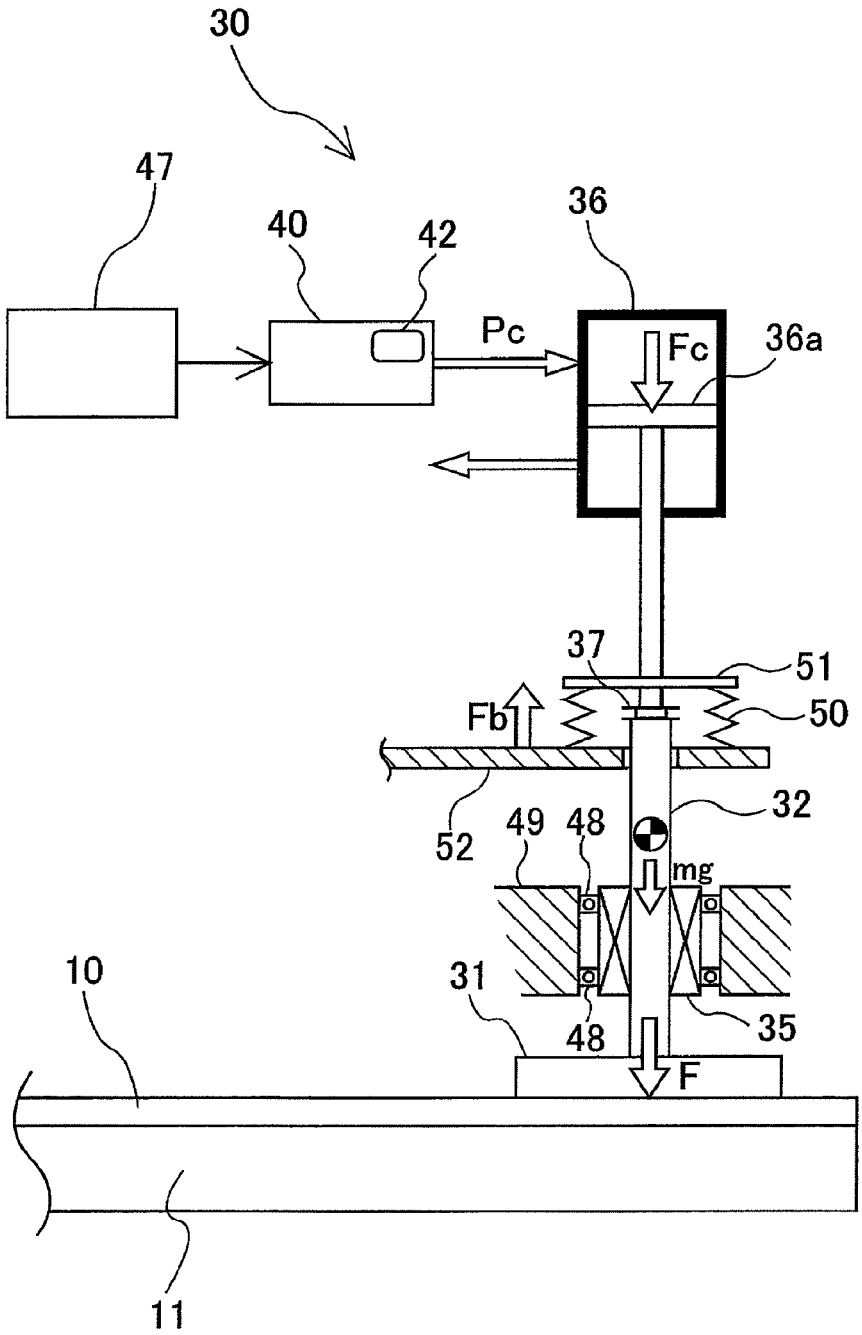
FIG. 5 is a schematic view showing a dressing apparatus according to a second embodiment of the present invention.

FIG. 5 is a schematic view showing the dressing unit according to a second embodiment of the present invention. Structures and operations of this embodiment, which will not be described below, are identical to those of the above-described first embodiment, and repetitive descriptions thereof will be omitted. As shown in FIG. 5, the lower pressure chamber of the air cylinder (i.e., pressing mechanism) 36 is vented to the atmosphere, while the upper pressure chamber is provided with the compressed air through the electropneumatic regulator 40, as with the above-described first embodiment. The dressing unit according the second embodiment includes a spring 50 for supporting the weight of the dresser assembly including the dresser disk 31 and the dresser drive shaft 32. This spring 50 is a lifting mechanism provided separately from the air cylinder 36. In this embodiment, the load cell 45 is not provided.

The spring 50 is mounted on a support base 52 that is secured to the dresser swing arm 33. The spring 50 has an upper end that is in contact with a spring stopper 51 secured to the dresser drive shaft 32. With these arrangements, the spring 50 exerts a force on the dresser drive shaft 32 in a direction opposite to the direction in which the air cylinder 36 presses the dresser disk 31, thereby biasing the dresser disk 31 upwardly through the dresser drive shaft 32. The coupling 37, which serves to couple the rotating section and the non-rotating section of the dresser drive shaft 32 to each other, is located below the spring stopper 51. The support base 52 for supporting the spring 50 and the support base 49 for supporting the ball spline 35 may be a single member.

Figure 6:
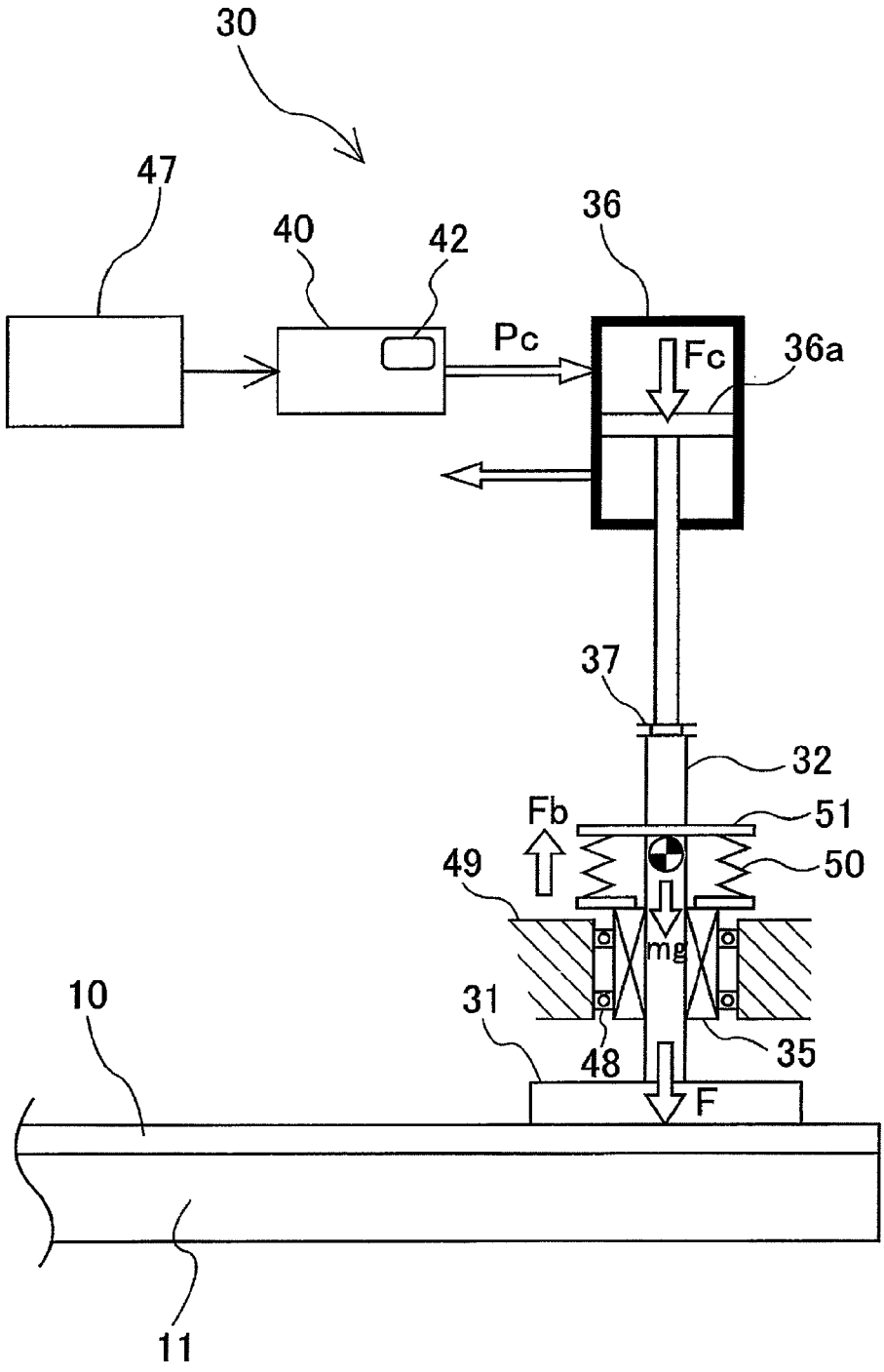
FIG. 6 is a schematic view showing a modified example of the dressing apparatus according to the second embodiment of the present invention.

FIG. 6 is a schematic view showing a modified example of the dressing unit according to the second embodiment of the present invention. In this modified example, the spring 50 is located below the coupling 37. The spring stopper 51 is secured to the rotating section of the dresser drive shaft 32. A lower end of the spring 50 is secured to the ball spline 35. The spring 50, the ball spline 35, and the dresser drive shaft 32 are rotated in unison.

Figure 7:
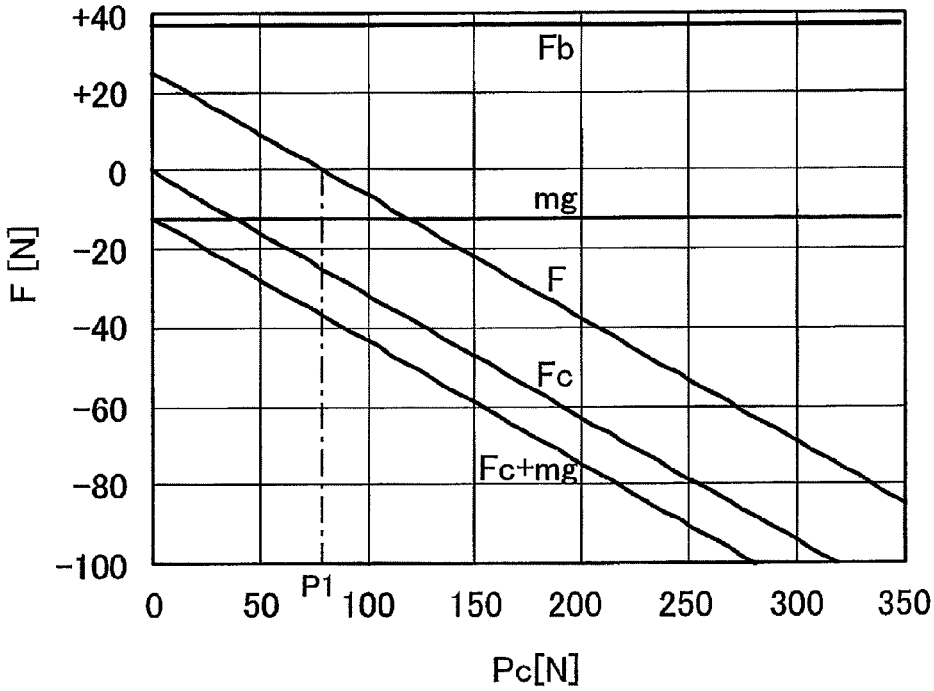
FIG. 7 is a graph showing a relationship between the pressure of the air in the upper pressure chamber of the air cylinder and the pressing force applied to a polishing pad.

In the dressing unit shown in FIG. 5 and FIG. 6, the pressing force F of the dresser disk 31 against the polishing pad 10 is expressed as a resultant force of a downward force Fc[N] generated by the air cylinder 36, a weight mg[N] of the dresser assembly in its entirety, and an upward force Fb[N] generated by the spring 50. FIG. 7 is a graph showing a relationship between the pressure Pc of the air supplied to the upper pressure chamber of the air cylinder 36 and the pressing force F acting on the polishing pad 10. In FIG. 7, a vertical axis indicates the pressing force F acting on the polishing pad 10, and a horizontal axis indicates the pressure Pc of the air in the upper pressure chamber of the air cylinder 36. A sign "+" along the vertical axis indicates an upward force and a sign "−" indicates a downward force. The graph shown in FIG. 7 is depicted on the assumption that the dresser disk 31 is in contact with the polishing pad 10 and that a length of the spring 50 is kept constant.

As shown in FIG. 7, when the pressure Pc is equal to or greater than P1, the pressing force is applied to the polishing pad 10 from the dresser disk 31. Since the upward force Fb produced by the spring 50 is added to the downward force Fc produced by the air cylinder 36, the force Fc is greater than the pressing force F acting on the polishing pad 10. The fact that the force Fc is large means that there is a large difference in the air pressure between the upper pressure chamber and the lower pressure chamber of the air cylinder 36. That is, a dead zone of the air cylinder 36 (i.e., a pressure range in which the piston 36*a* does not move due to frictional resistance between the piston 36*a* and a cylinder when the difference in the air pressure between the upper pressure chamber and the lower pressure chamber is small) is separated from an operation range of the air cylinder 36. Therefore, even when the pressing force F is small (e.g., 10 N or less), the air cylinder 36 can operate smoothly. Moreover, because the pressing force F can be set small, an amount of the polishing pad 10 that is scraped off can be small. Consequently, the life of the polishing pad 10 can be increased.

The spring 50, as the lifting mechanism, does not have sliding elements, unlike the air cylinder 36. Therefore, use of the spring 50 does not cause an increase in the sliding resistance, and the air cylinder 36 can change the pressing force F of the dresser disk 31 smoothly within a wide range including 0[N]. As a result, the dresser disk 31 can press the polishing pad 10 at small pressing force F stably.

A coil spring is preferably used as the spring 50. Instead of the spring 50, an air spring (e.g., an air bag formed by a flexible or deformable material) with a gas enclosed therein may be used as the lifting mechanism. In order to reduce the sliding resistance, it is preferable to use, as the air cylinder 36, a metal air cylinder which does not use a lip seal between a piston and a cylinder or a non-contact seal air cylinder having a non-contact seal disposed between a piston and a cylinder.

Figure 8:
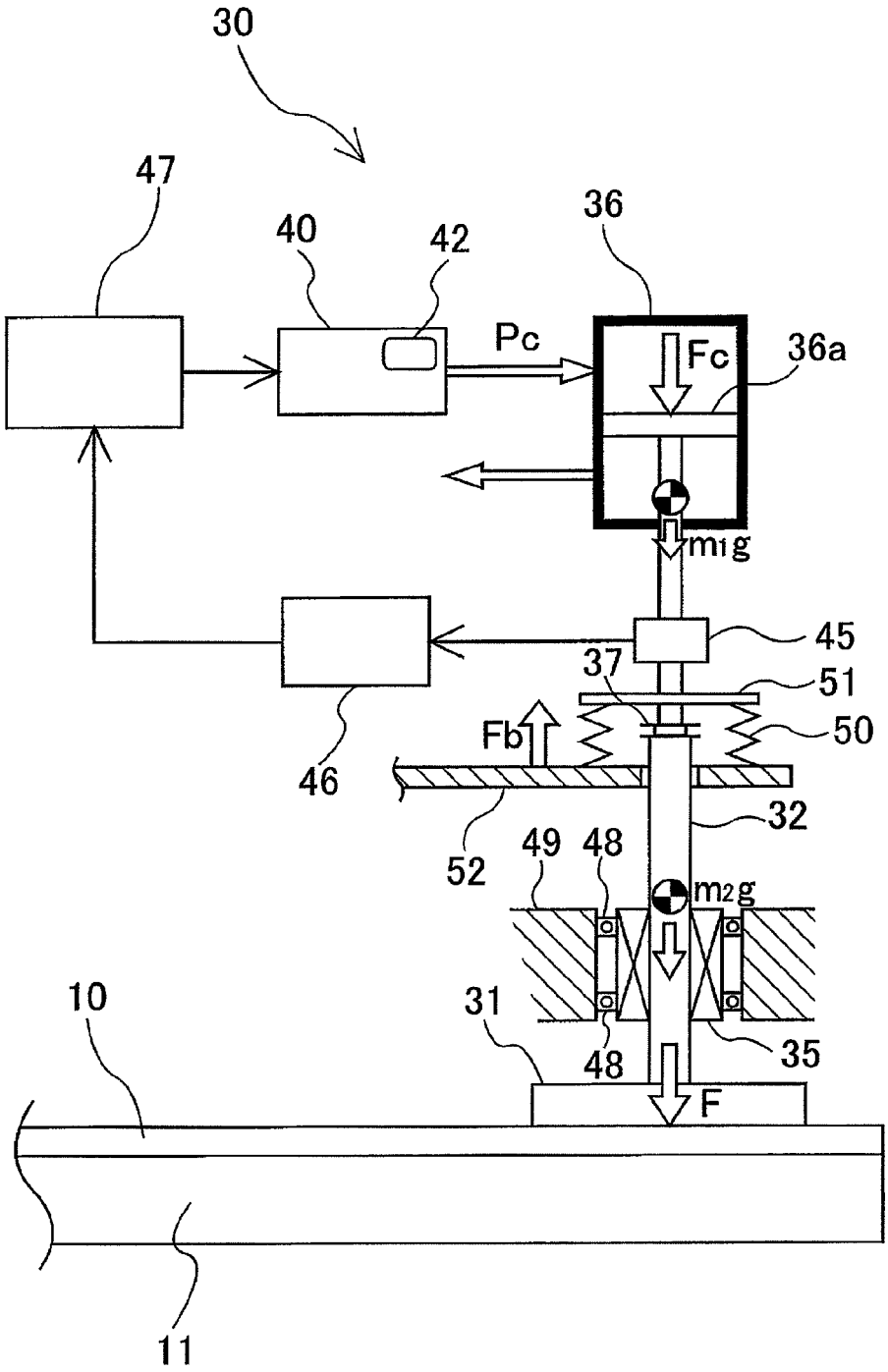
FIG. 8 is a schematic view showing a dressing apparatus according to a third embodiment of the present invention.

FIG. 8 is a schematic view showing the dressing unit according to a third embodiment of the present invention. Structures and operations of this embodiment, which will not be described below, are identical to those of the above-described second embodiment, and repetitive descriptions thereof will be omitted. In this embodiment, load cell 45, which serves as a load-measuring device, is integrated in the dresser drive shaft 32. This load cell 45 is located between the air cylinder 36 and the spring 50 and is electrically connected to the pressure controller 47 via the amplifier 46.

In this embodiment, a difference between the actual pressing force of the dresser disk 31 and the measurement value of the load cell 45 corresponds to the upward force of the spring 50 and the weight of the dresser assembly. The difference between the pressing force F of the dresser disk 31 and the measurement value F' of the load cell 45 will be described below.

When the air is not supplied into the upper pressure chamber of the air cylinder 36 (i.e., when Fc is zero), the dresser assembly is elevated by the spring 50 and the dresser disk 31 is located away from the polishing pad 10. Hereinafter, this state will be referred to as an initial state. In this initial state, the piston 36*a* is in contact with the upper end of the cylinder by receiving the lifting force of the spring 50. This lifting force Fb of the spring 50 is expressed as $$Fb=Fb_0+k\cdot Z \tag{4}$$

where $Fb_0$ is the lifting force [N] of the spring 50 in the initial state, k is a spring constant [N/mm], and Z is a displacement [mm] of the dresser assembly from its initial position (i.e., a position in the initial state).

In the initial state, the force Fc of the air cylinder 36 is zero. The displacement Z is also zero. Therefore, the lifting force Fb of the spring 50 is $Fb_0$. In the initial state, the weights $m_1g$ and $m_2g$ of the dresser assembly and the lifting force $Fb_0$ (=Fb) of the spring 50 act on the load cell 45. The weight $m_2g$ of the lower part of the dresser assembly acts as a tensile force on the load cell 45. Therefore, the measurement value F' of the load cell 45 is expressed by the following equation.

$$F'=Fb_0+m_1g-m_2g \tag{5}$$

When the air is supplied into the upper pressure chamber of the air cylinder 36, it generates the downward force Fc. When the downward force Fc exceeds a certain value, the dresser assembly is lowered against the lifting force of the spring 50. When the dresser assembly is lowered slightly from the initial position and is still hanging in the air (i.e., Fc≠0, Z≠0, F=0), the following equation holds from the condition of equilibrium of forces.

$$\begin{aligned} F &= Fc - Fb + m_1g + m_2g \\ &= Fc - (Fb_0 + k\cdot Z) + m_1g + m_2g = 0 \end{aligned} \tag{6}$$

Since the above equation (6) contains a variable Z, the dresser assembly comes to rest at a certain position that depends on the force Fc. Therefore, even if the pressing force F of the dresser disk 31 is zero or approximately zero, the position of the dresser disk 31 is stable. This indicates that the dresser disk 31 can dress the polishing pad 10 at a very small force.

The measurement value F' of the load cell 45 when the dresser assembly is suspended is given by $$\begin{aligned} F' &= Fc + Fb + m_1g - m_2g \\ &= Fc + (Fb_0 + k\cdot Z) + m_1g - m_2g \end{aligned} \tag{7}$$

As the force Fc is further increased, the dresser disk 31 is further lowered to contact the polishing pad 10. In this contact state (i.e., Fc≠0, Z≠0, F≠0), the pressing force F is expressed as follows.

$$\begin{aligned} F &= Fc - Fb + m_1g + m_2g \\ &= Fc - (Fb_0 + k\cdot Z) + m_1g + m_2g \end{aligned} \tag{8}$$

On the other hand, the measurement value F', as the output of the load cell 45, is expressed as follows.

$$\begin{aligned} F' &= Fc + Fb + m_1g - m_2g \\ &= Fc + (Fb_0 + k\cdot Z) + m_1g - m_2g \end{aligned} \tag{9}$$

Accordingly, the difference ΔS between the pressing force F and the measurement value F' is given as follows.

$$\Delta S=F-F'=2m_2g-2(Fb_0+k\cdot Z) \tag{10}$$

Therefore, the pressing force F can be given by adding the difference ΔS ($=2m_2g-2(Fb_0+k\cdot Z)$), as the amount of correction, to the measurement value F' that is obtained from the load cell 45. This amount of correction ΔS can be given by the known values $Fb_0$, k, $m_2g$ and an actually measured value of the displacement Z. Alternatively, a load cell for calibration may be placed between the dresser disk 31 and the polishing pad 10 to obtain an actual pressing force of the dresser disk 31 applied to the polishing pad 10, and the amount of correction ΔS may be determined by subtracting the measurement value F' of the load cell 45 from the actual pressing force (i.e., a measurement value of the load cell for calibration).

The amount of correction ΔS is affected by the spring constant k [N/mm] of the spring 50. More specifically, a position of the dresser disk 31 in the vertical direction when the dresser disk 31 is in contact with the polishing pad 10 (hereinafter, this position will be referred to as a pressing position) is lowered in accordance with wear of the polishing pad 10. When the pressing position of the dresser disk 31 is lowered by AZ due to the wear of the polishing pad 10, the lifting force Fb of the spring 50 is increased by k·ΔZ. As a result, the pressing force F of the dresser disk 31 is decreased by k·ΔZ. Therefore, use of the spring having a small spring constant k can reduce the influence on the pressing force F. For example, when the spring constant k is 1 N/mm and the amount of the wear of the polishing pad is 0.5 mm, the pressing force F is decreased by about 0.5 N.

As with the first embodiment, the pressure controller 47 performs the calibration for determining the relationship between the pressing force of the dresser disk 31 and the pressure of the air supplied to the upper pressure chamber of the air cylinder 36, based on the measurement values obtained from the load cell 45 and the measurement values obtained from the pressure sensor 42. This calibration is performed automatically by the pressure controller 47 at a predetermined timing, e.g., immediately before or immediately after dressing of the polishing pad 10. The calibration may be performed during dressing. Since the pressing force F varies in accordance with the wear of the polishing pad 10 as described above, it is preferable to carry out the calibration periodically.

Figure 9:
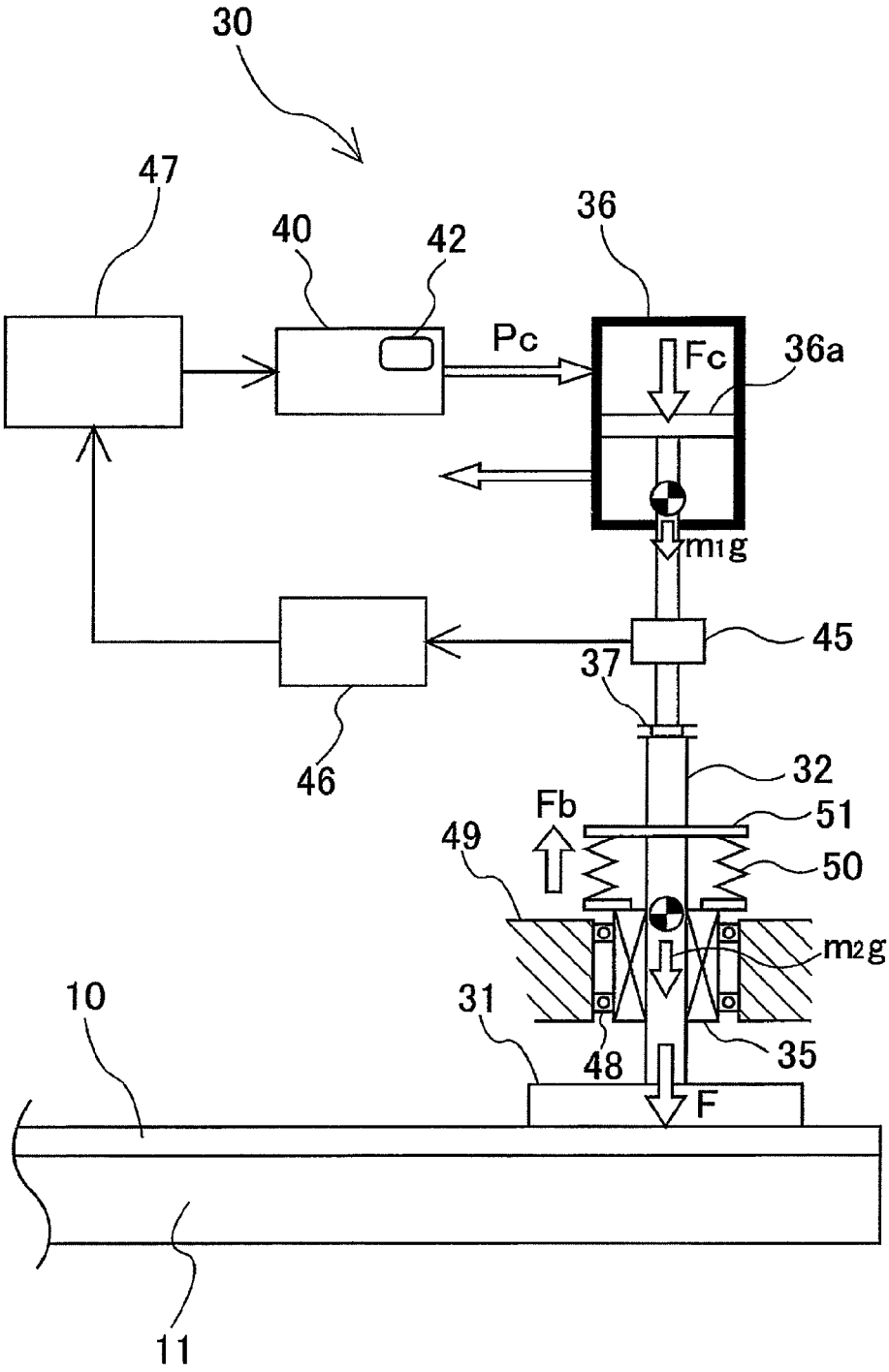
FIG. 9 is a schematic view showing a modified example of the dressing apparatus according to the third embodiment of the present invention.

FIG. 9 is a schematic view showing a modified example of the dressing unit according to the third embodiment of the present invention. In this modified example, the spring 50 is arranged below the coupling 37. The spring stopper 51 is secured to the rotating section of the dresser drive shaft 32, and the lower end of the spring 50 is secured to the ball spline 35. The spring 50, the ball spline 35, and the dresser drive shaft 32 are rotated in unison. In this example also, the difference ΔS (i.e., the amount of correction) between the pressing force F of the dresser disk 31 and the measurement value F' of the load cell 45 is determined according to the same procedures as discussed above.

Figure 10:
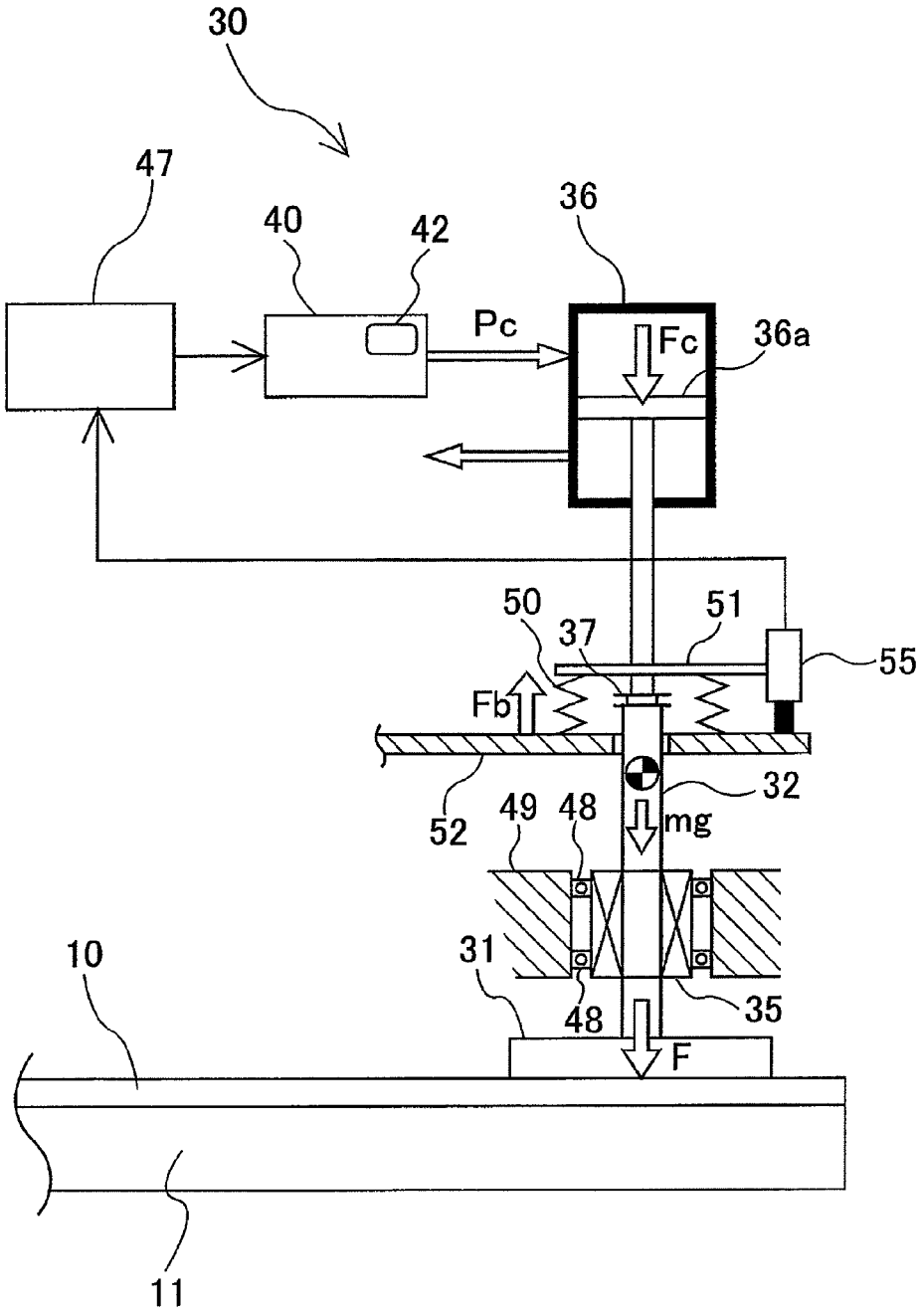
FIG. 10 is a schematic view showing a dressing apparatus according to a fourth embodiment of the present invention.

FIG. 10 is a schematic view showing the dressing unit according to a fourth embodiment of the present invention. Structures and operations of this embodiment, which will not be described below, are identical to those of the above-described second embodiment, and repetitive descriptions thereof will be omitted. As shown in FIG. 10, the dressing unit includes a position sensor 55 for measuring the position of the dresser disk 31 in the vertical direction. This position sensor 55 is secured to the spring stopper 51, so that the position sensor 55 moves in the vertical direction in unison with the dresser drive shaft 32. The position sensor 55 has a probe contacting the support base 52 on which the spring 50 is mounted. The position sensor 55 measures a relative position of the dresser drive shaft 32 in the vertical direction with respect to the support base 52, i.e., the position of the dresser disk 31 in the vertical direction. This position sensor 55 is a contact-type position sensor whose probe contacts a measurement target, but a non-contact-type position sensor may be used alternatively.

The pressing position of the dresser disk 31 is lowered according to the wear of the polishing pad 10. Therefore, the amount of the wear of the polishing pad 10 can be expressed as a displacement of the pressing position of the dresser disk 31 (i.e., displacement from an initial pressing position). Thus, the position sensor 55 measures the position of the dresser drive shaft 32 in the vertical direction when the dresser disk 31 is in contact with the polishing pad 10 to thereby indirectly measure the amount of the wear of the polishing pad 10. The measurement value of the position sensor 55 is transmitted to the pressure controller 47, where the measurement value from the position sensor 55, i.e., the amount of the wear of the polishing pad 10, is monitored.

As the polishing pad 10 wears, the lifting force Fb of the spring 50 is increased. As a result, the pressing force F of the dresser disk 31 against the polishing pad 10 is decreased. When the pressing force F is decreased, intended dressing of the polishing pad 10 may not be performed. To avoid such drawback, the pressure controller 47 increases the air pressure in the upper pressure chamber of the air cylinder 36 so as to compensate for the decrease in the pressing force F. The decrease in the pressing force F is due to the change in the lifting force Fb of the spring 50 as a result of the wear of the polishing pad. Therefore, an amount ΔF of the decrease in the pressing force F is given by $$\Delta F = k \cdot \Delta Z \tag{11}$$

where ΔZ represents a displacement of the pressing position of the dresser disk 31, i.e., the amount of the wear of the polishing pad 10.

The pressure controller 47 calculates the amount ΔZ of the wear of the polishing pad 10 from the measurement value obtained from the position sensor 55, and calculates the amount ΔF of the decrease in the pressing force in accordance with the above equation (11). Further, the pressure controller 47 determines the air pressure ΔPc for generating the obtained value ΔF using $$\Delta Pc = \Delta F / A \tag{12}$$

where A represents an effective pressure-receiving area of the piston 36*a*.

The pressure controller 47 increases the air pressure in the upper pressure chamber of the air cylinder 36 by ΔPc to thereby correct the force Fc, generated by the air cylinder 36, in accordance with the amount of the wear of the polishing pad 10. This correcting operation enables the dresser disk 31 to dress the polishing pad 10 at a constant pressing force F, regardless of the wear of the polishing pad 10.

Figure 11:
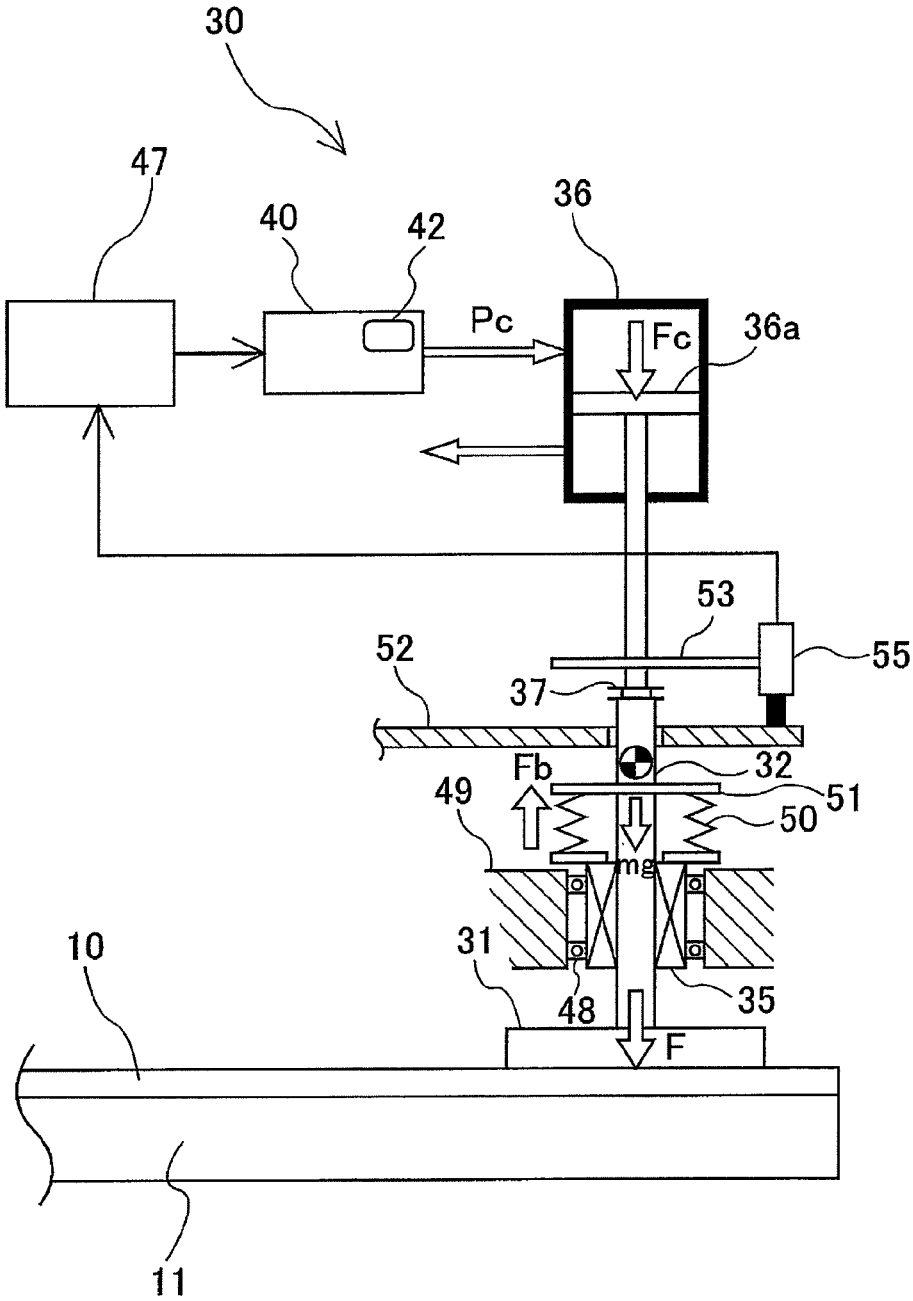
FIG. 11 is a schematic view showing a modified example of the dressing apparatus according to the fourth embodiment of the present invention.

FIG. 11 is a schematic view showing a modified example of the dressing unit according to the fourth embodiment of the present invention. In this modified example, the spring 50 is arranged below the coupling 37. The spring stopper 51 is secured to the rotating section of the dresser drive shaft 32, and the lower end of the spring 50 is secured to the ball spline 35. The spring 50, the ball spline 35, and the dresser drive shaft 32 are rotated in unison. The position sensor 55 is supported by an arm 53 secured to the non-rotating section of the dresser drive shaft 32. The probe of the position sensor 55 is in contact with the support base 52. The amount of the wear of the polishing pad 10 is measured indirectly by the position sensor 55.

Figure 12:
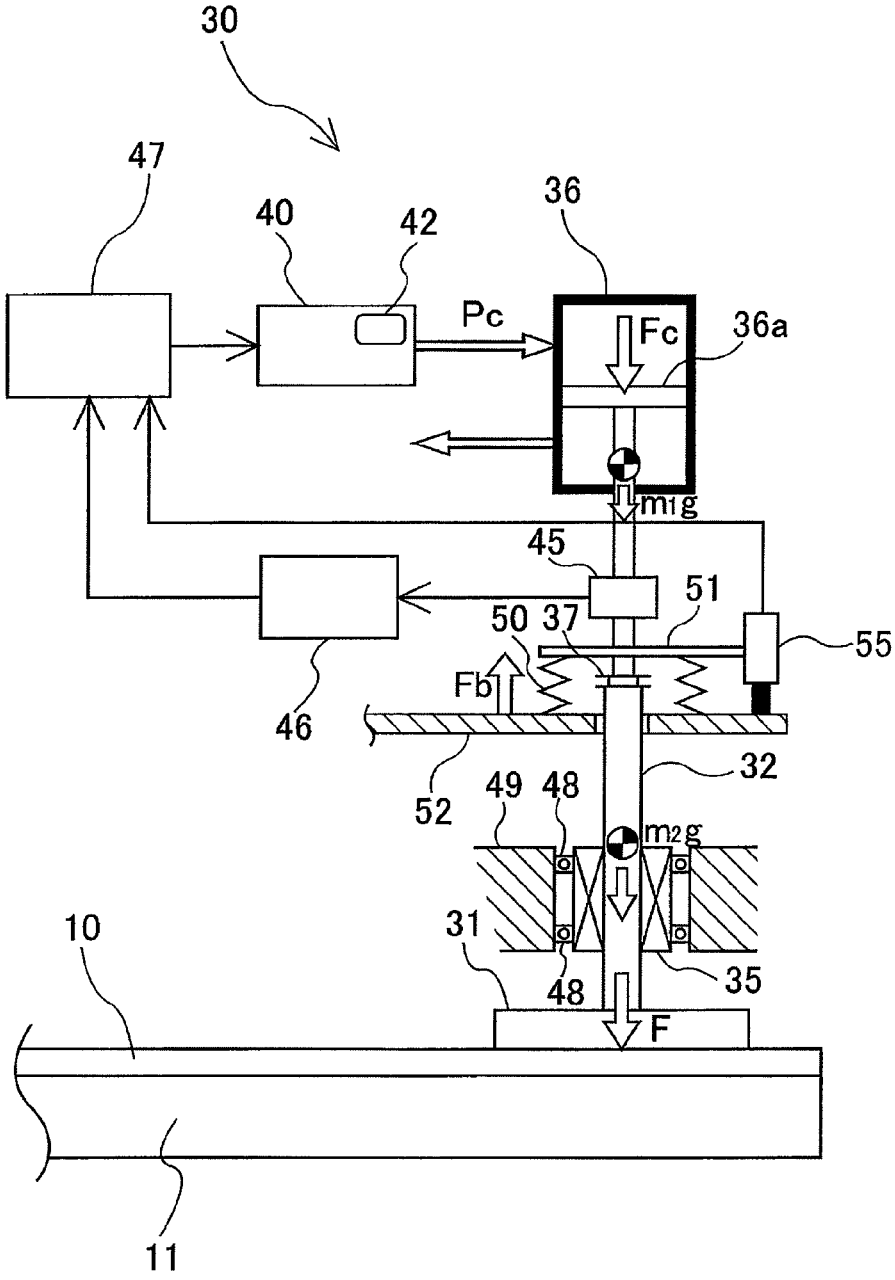
FIG. 12 is a schematic view showing a dressing apparatus according to a fifth embodiment of the present invention.

FIG. 12 is a schematic view showing the dressing unit according to a fifth embodiment of the present invention. Structures and operations of this embodiment, which will not be described below, are identical to those of the above-described fourth embodiment, and repetitive descriptions thereof will be omitted. In this embodiment, load cell 45, serving as a load-measuring device, is provided in the dresser drive shaft 32. This load cell 45 is located between the air cylinder 36 and the spring 50 and is coupled to the pressure controller 47 via the amplifier 46. As with the first embodiment, the pressure controller 47 performs the calibration for determining the relationship between the pressing force of the dresser disk 31 and the pressure of the air supplied to the upper pressure chamber of the air cylinder 36, based on the measurement values obtained from the load cell 45 and the measurement values obtained from the pressure sensor 42.

In the structures shown in FIG. 12, the pressure controller 47 may perform the calibration when the amount of the wear of the polishing pad 10, which is determined from the measurement value of the position sensor 55, has reached a preset value. The calibration according to the amount of the wear of the polishing pad 10 can prevent a variation in the pressing force F of the dresser disk 31. Further, the calibration may be performed regularly in synchronization with pad search which is carried out by the top ring unit 20 (see FIG. 2). The pad search is an operation of searching for a reference height of the top ring 21 when polishing a substrate. More specifically, the top ring 21 is lowered from its elevated rest position until it contacts the polishing pad 10, and a height of the top ring 21 when contacting the polishing pad 10 is determined to be the reference height for the polishing process.

In a preferred example, the pressure controller 47 controls the pressure Pc of the air supplied into the upper pressure chamber of the air cylinder 36 based on the measurement value of the load cell 45 such that the dresser disk 31 maintains a predetermined target pressing force during dressing of the polishing pad 10. Such feedback control can enable the dresser disk 31 to keep its pressing force F constant regardless of the wear of the polishing pad 10.

Figure 13:
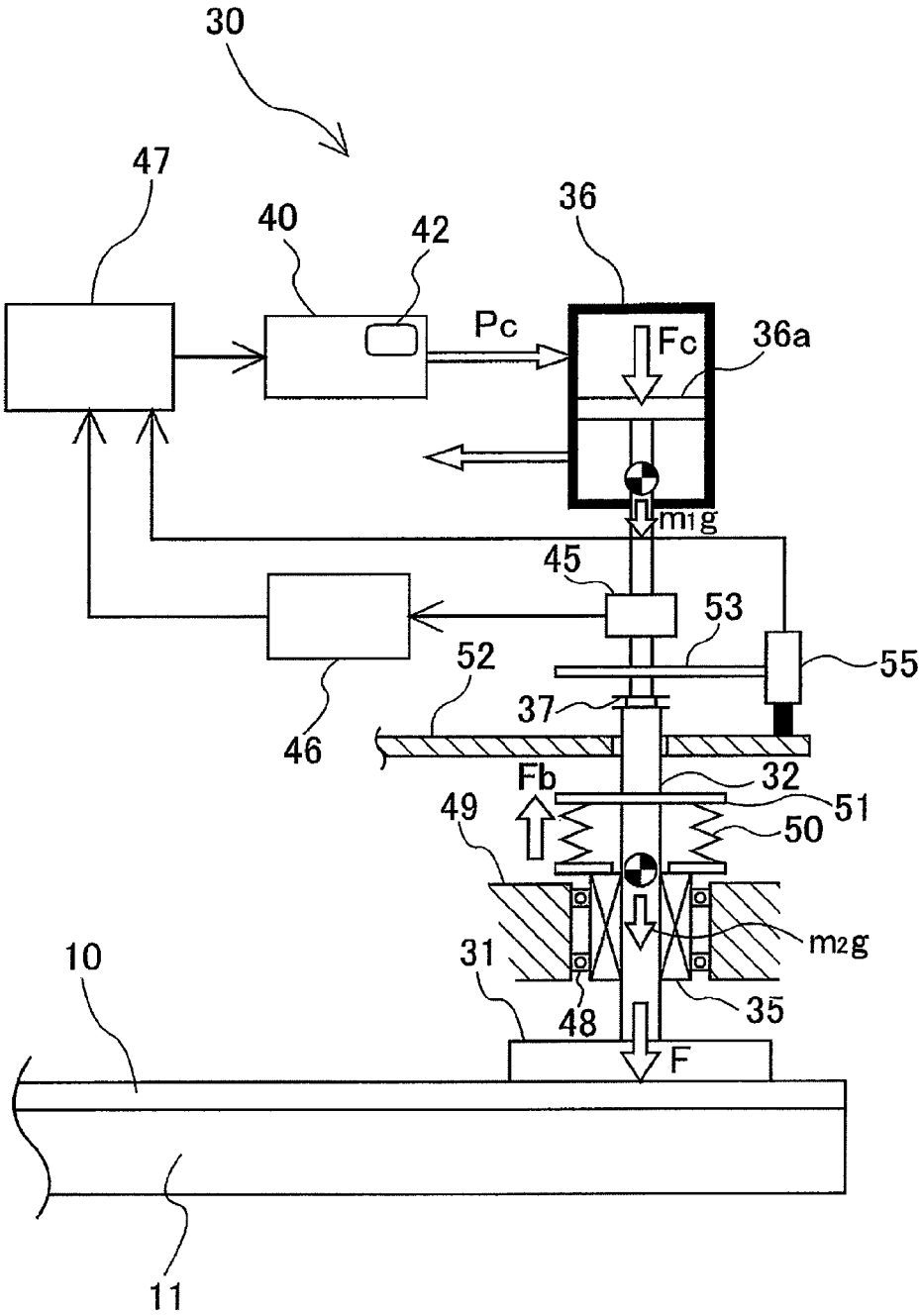
FIG. 13 is a schematic view showing a modified example of the dressing apparatus according to the fifth embodiment of the present invention.

FIG. 13 is a schematic view showing a modified example of the dressing unit according to the fifth embodiment of the present invention. In this modified example, the spring 50 is arranged below the coupling 37. The spring stopper 51 is secured to the rotating section of the dresser drive shaft 32, and the lower end of the spring 50 is secured to the ball spline 35. The spring 50, the ball spline 35, and the dresser drive shaft 32 are rotated in unison. The position sensor 55 is supported by the arm 53 secured to the non-rotating section of the dresser drive shaft 32. The probe of the position sensor 55 is in contact with the support base 52. The amount of the wear of the polishing pad 10 is measured indirectly by the position sensor 55.

Figure 14:
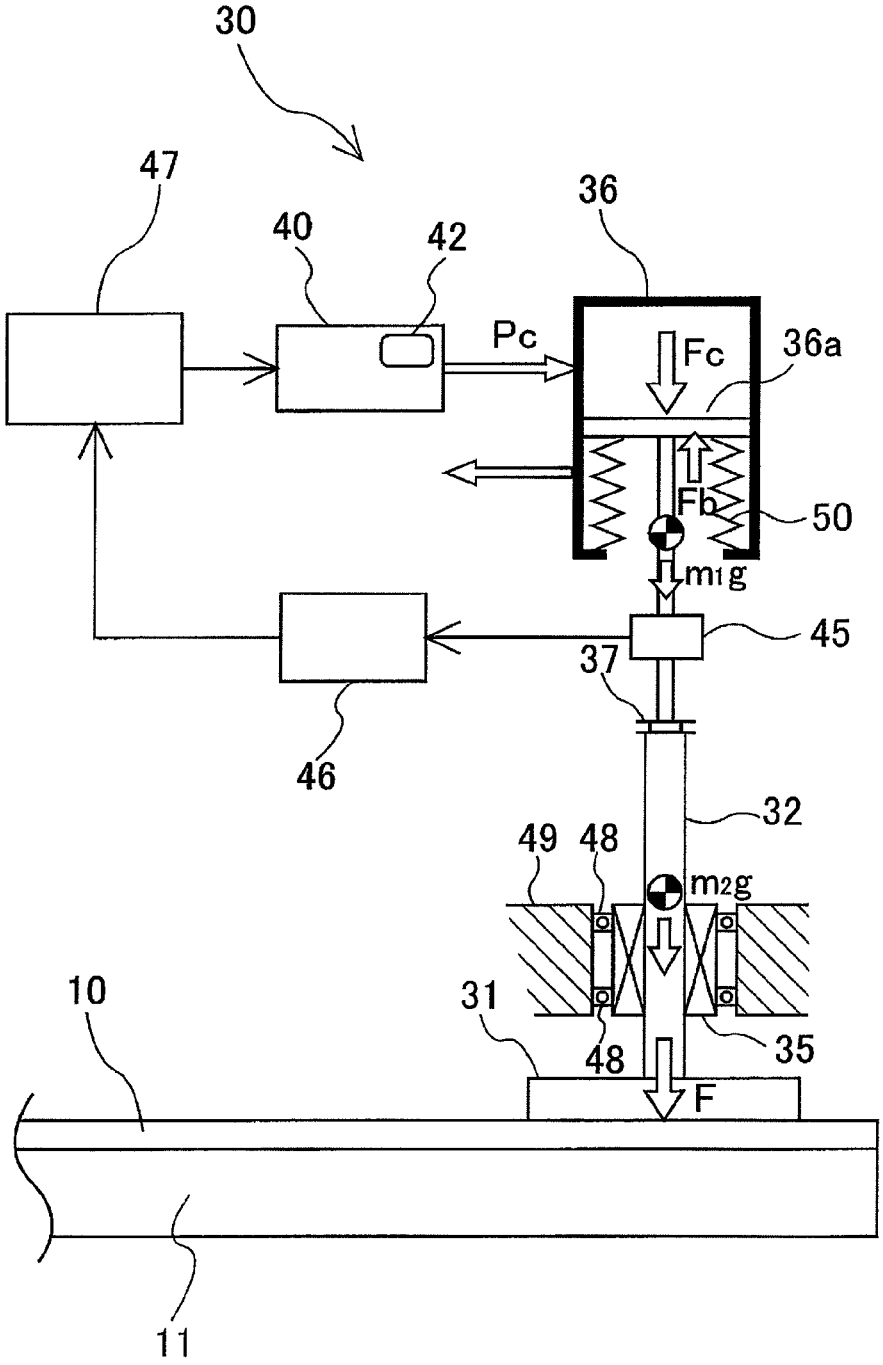
FIG. 14 is a schematic view showing a dressing apparatus according to a sixth embodiment of the present invention.

FIG. 14 is a schematic view showing the dressing unit according to a sixth embodiment of the present invention. Structures and operations of this embodiment, which will not be described below, are identical to those of the above-described third embodiment, and repetitive descriptions thereof will be omitted. In this embodiment, spring 50 is arranged above the load cell 45. More specifically, the spring 50 is provided inside the air cylinder 36 and is arranged so as to press the piston 36*a* from below. It is noted that the location of the spring 50 is not limited to this example and the spring 50 may be located in other places as long as the spring 50 is arranged between the air cylinder 36 and the load cell 45.

In this embodiment, the difference between the actual pressing force of the dresser disk 31 and the measurement value of the load cell 45 corresponds to the weight of the dresser assembly. The difference between the pressing force F of the dresser disk 31 and the measurement value F' of the load cell 45 will be described below.

In the initial state (i.e., Fc=0, Z=0, F=0), only the downward force $m_2g$ acts as a tensile force on the load cell 45. The lifting force Fb of the spring 50 and the weight $m_1g$ of the upper part of the dresser assembly do not act on the load cell 45. Therefore, the measurement value F' at the load cell 45 is expressed as $$F'=-m_2g \tag{13}$$

When the air is supplied into the upper pressure chamber of the air cylinder 36 to lower the dresser assembly slightly from the initial position and the dresser assembly is still suspended in the air (i.e., Fc≠0, Z≠0, F=0), the following equation holds from the condition of equilibrium of forces.

$$\begin{aligned} F &= Fc - Fb + m_1g + m_2g \\ &= Fc - (Fb_0 + k \cdot Z) + m_1g + m_2g = 0 \end{aligned} \tag{14}$$

Since the above equation (14) contains the variable Z, the dresser assembly comes to rest at a certain position that depends on the force Fc. Therefore, even if the pressing force F of the dresser disk 31 is zero or approximately zero, the position of the dresser disk 31 is stable. This indicates that the dresser disk 31 can dress the polishing pad 10 at a very small force.

In this suspended state, only the downward force $m_2g$ acts as a tensile force on the load cell 45. Therefore, the measurement value F' of the load cell 45 is expressed as $$F'=-m_2g \tag{15}$$

When the dresser disk 31 is in contact with the polishing pad 10 (i.e., Fc≠0, Z≠0, F≠0), the pressing force F is expressed as $$F=Fc-Fb+m_1g+m_2g \tag{16}$$

On the other hand, the measurement value F', which is the output of the load cell 45, is expressed as $$F'=Fc-Fb+m_1g \tag{17}$$

Accordingly, the difference ΔS between the pressing force F and the measurement value F' is given as follows.

$$\Delta S=F-F'=m_2g \tag{18}$$

Therefore, the pressing force F can be given by adding the difference ΔS (=$m_2g$), as the amount of correction, to the measurement value F' of the load cell 45. This amount of correction ΔS can be obtained by a measurement value of the load cell 45 when the dresser disk 31 is out of contact with the polishing pad 10. Alternatively, a load cell for calibration may be placed between the dresser disk 31 and the polishing pad 10 to obtain an actual pressing force of the dresser disk 31 applied to the polishing pad 10, and the amount of correction ΔS may be determined by subtracting the measurement value F' of the load cell 45 from the actual pressing force (i.e., the measurement value of the load cell for calibration). Since the amount of correction ΔS (=$m_2g$) does not contain the variable Z, the value ΔS is constant regardless of the wear of the polishing pod 10. Therefore, once the amount of correction ΔS is determined, the value thereof can be used as it is repetitively.

As with the first embodiment, the pressure controller 47 performs the calibration for determining the relationship between the pressing force of the dresser disk 31 and the pressure of the air supplied to the upper pressure chamber of the air cylinder 36, based on the measurement values of the load cell 45 and the measurement values of the pressure sensor 42. This calibration is performed automatically by the pressure controller 47 at a predetermined timing, e.g., immediately before or immediately after dressing of the polishing pad 10. The dressing unit of this embodiment may include the position sensor 55 according to the fifth embodiment. In this case, as discussed in the fifth embodiment, it is preferable that the pressure controller 47 perform the calibration when the amount of the wear of the polishing pad 10, which is determined from the measurement value of the position sensor 55, has reached a preset value.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims and equivalents.

What is claimed is:

1. A dressing apparatus for dressing a polishing pad, said dressing apparatus comprising:

a dresser disk to be brought into sliding contact with the polishing pad;

a vertically movable dresser drive shaft coupled to said dresser disk;

a pressing mechanism configured to receive a supply of a gas to press said dresser disk against the polishing pad through said vertically movable dresser drive shaft;

a pressure-measuring device configured to measure pressure of the gas supplied to said pressing mechanism;

a load-measuring device incorporated in said vertically movable dresser drive shaft and configured to measure a load acting on said vertically movable dresser drive shaft, said load-measuring device being located between said pressing mechanism and said dresser disk; and a pressure controller configured to control the pressure of the gas supplied to said pressing mechanism, calculate a pressing force of said dresser disk against the polishing pad by adding a predetermined amount of correction to a measurement value of said load-measuring device, the predetermined amount of correction being a weight of a lower part of a dresser assembly that comprises vertically movable components including said dresser disk and said vertically moveable dresser drive shaft, said lower part of said dresser assembly being lower than said load-measuring device, and establish a relationship between the pressure of the gas and the pressing force of said dresser disk against the polishing pad, based on measurement values of said pressure-measuring device and the calculated pressing force of said dresser disk.

2. A polishing apparatus for polishing a substrate, said polishing apparatus comprising:

a rotatable polishing table for supporting a polishing pad;

a top ring configured to press the substrate against the polishing pad; and a dressing apparatus comprising:

a dresser disk to be brought into sliding contact with the polishing pad;

a vertically movable dresser drive shaft coupled to said dresser disk;

a pressing mechanism configured to receive a supply of a gas to press said dresser disk against the polishing pad through said vertically movable dresser drive shaft;

a pressure-measuring device configured to measure pressure of the gas supplied to said pressing mechanism;

a load-measuring device incorporated in said vertically movable dresser drive shaft and configured to measure a load acting on said vertically movable dresser drive shaft, said load-measuring device being located between said pressing mechanism and said dresser disk; and a pressure controller configured to control the pressure of the gas supplied to said pressing mechanism, calculate a pressing force of said dresser disk against the polishing pad by adding a predetermined amount of correction to a measurement value of said load-measuring device, the predetermined amount of correction being a weight of a lower part of a dresser assembly that comprises vertically movable components including said dresser disk and said vertically moveable dresser drive shaft, said lower part of said dresser assembly being lower than said load-measuring device, and establish a relationship between the pressure of the gas and the pressing force of said dresser disk against the polishing pad, based on measurement values of said pressure-measuring device and the calculated pressing force of said dresser disk.

3. A dressing apparatus for dressing a polishing pad, said dressing apparatus comprising:

a dresser disk to be brought into sliding contact with the polishing pad;

a vertically movable dresser drive shaft coupled to said dresser disk;

a pneumatic cylinder configured to receive a supply of a gas to press said dresser disk against the polishing pad through said vertically movable dresser drive shaft;

a load-measuring device incorporated in said vertically movable dresser drive shaft and configured to measure a load acting on said vertically movable dresser drive shaft, said load-measuring device being located between said pneumatic cylinder and said dresser disk;

a pressure-measuring device configured to measure pressure of the gas supplied to said pneumatic cylinder;

a lifting mechanism configured to lift said dresser disk through said vertically movable dresser drive shaft; and a pressure controller configured to control the pressure of the gas supplied to said pneumatic cylinder, calculate an amount of correction from a lifting force of said lifting mechanism and a weight of a lower part of a dresser assembly that comprises vertically movable components including said dresser disk and said vertically moveable dresser drive shaft, said lower part of said dresser assembly being lower than said load-measuring device, and calculate a pressing force of said dresser disk against the polishing pad by adding the amount of correction to a measurement value of said load-measuring device.

4. The dressing apparatus according to claim 3, wherein said lifting mechanism comprises a spring.

5. The dressing apparatus according to claim 3, further comprising:

a position sensor configured to measure a position of said dresser disk in a vertical direction when said dresser disk is in contact with the polishing pad.

6. The dressing apparatus according to claim 5, wherein said pressure controller is configured to change the pressure of the gas supplied to said pneumatic cylinder based on a measurement value of said position sensor.

7. The dressing apparatus according to claim 5, wherein said pressure controller is configured to determine an amount of wear of the polishing pad from a measurement value of said position sensor and establish a relationship between the pressure of the gas and the pressing force of said dresser disk against the polishing pad, based on measurement values of said pressure-measuring device and the calculated pressing force of said dresser disk, when the amount of wear of the polishing pad has reached a predetermined value.

8. The dressing apparatus according to claim 3, wherein said pressure controller is configured to establish a relationship between the pressure of the gas and the pressing force of said dresser disk against the polishing pad, based on measurement values of said pressure-measuring device and the calculated pressing force of said dresser disk.

9. The dressing apparatus according to claim 3, wherein said pressure controller is configured to control the pressure of the gas such that the pressing force of said dresser disk against the polishing pad is kept at a predetermined target value during dressing of the polishing pad.

10. A polishing apparatus for polishing a substrate, said polishing apparatus comprising:

a rotatable polishing table for supporting a polishing pad;

a top ring configured to press the substrate against the polishing pad; and a dressing apparatus comprising:

a dresser disk to be brought into sliding contact with the polishing pad;

a vertically movable dresser drive shaft coupled to said dresser disk;

a pneumatic cylinder configured to receive a supply of gas to press said dresser disk against the polishing pad through said vertically movable dresser drive shaft;

a load-measuring device incorporated in said vertically movable dresser drive shaft and configured to measure a load acting on said vertically movable dresser drive shaft, said load-measuring device being located between said pneumatic cylinder and said dresser disk;

a pressure-measuring device configured to measure pressure of the gas supplied to said pneumatic cylinder;

a lifting mechanism configured to lift said dresser disk through said vertically movable dresser drive shaft; and a pressure controller configured to control the pressure of the gas supplied to said pneumatic cylinder, calculate an amount of correction from a lifting force of said lifting mechanism and a weight of a lower part of a dresser assembly that comprises vertically movable components including said dresser disk and said vertically moveable dresser drive shaft, said lower part of said dresser assembly being lower than said load-measuring device, and calculate a pressing force of said dresser disk against the polishing pad by adding the amount of correction to a measurement value of said load-measuring device.

11. A method of dressing a polishing pad, said method comprising:

rotating a dresser disk and the polishing pad;

pressing the dresser disk against the polishing pad through a vertically moveable dresser drive shaft by a pressing mechanism that is actuated by receiving a supply of a gas;

measuring pressure of the gas supplied to the pressing mechanism;

measuring a load acting on the vertically moveable dresser drive shaft by a load-measuring device incorporated in the vertically moveable dresser drive shaft, the load-measuring device being located between the pressing mechanism and the dresser disk;

controlling the pressure of the gas supplied to the pressing mechanism;

calculating a pressing force of the dresser disk against the polishing pad by adding a predetermined amount of correction to a measurement value of the load-measuring device, the predetermined amount of correction being a weight of a lower part of a dresser assembly that comprises vertically movable components including the dresser disk and the vertically moveable dresser drive shaft, the lower part of the dresser assembly being lower than the load-measuring device; and establishing a relationship between the pressure of the gas and the pressing force of the dresser disk against the polishing pad, based on measurement values of the pressure of the gas and the calculated pressing force of the dresser disk.

* * * * *